US009272861B2

(12) United States Patent
Tateishi et al.

(10) Patent No.: US 9,272,861 B2
(45) Date of Patent: Mar. 1, 2016

(54) SHEET FEEDING UNIT AND IMAGE FORMING APPARATUS

(71) Applicant: CANON KABUSHIKI KAISHA, Tokyo (JP)

(72) Inventors: Satohisa Tateishi, Abiko (JP); Kozo Inoue, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/488,622

(22) Filed: Sep. 17, 2014

(65) Prior Publication Data

US 2015/0084269 A1 Mar. 26, 2015

(30) Foreign Application Priority Data

Sep. 25, 2013 (JP) ..... 2013-197766
Aug. 26, 2014 (JP) ..... 2014-171783

(51) Int. Cl.
*B65H 3/06* (2006.01)
*B65H 1/04* (2006.01)
*B65H 1/26* (2006.01)

(52) U.S. Cl.
CPC ..... *B65H 3/0684* (2013.01); *B65H 1/04* (2013.01); *B65H 1/266* (2013.01); *B65H 2511/212* (2013.01); *B65H 2511/51* (2013.01); *B65H 2511/515* (2013.01); *B65H 2601/272* (2013.01); *B65H 2801/06* (2013.01)

(58) Field of Classification Search
CPC ..... B65H 3/0684; B65H 3/0669; B65H 3/06; B65H 1/266; B65H 1/04
See application file for complete search history.

(56) References Cited

U.S. PATENT DOCUMENTS

| | | | | |
|---|---|---|---|---|
| 5,501,444 | A * | 3/1996 | Yukimachi et al. | 271/127 |
| 6,299,157 | B1 * | 10/2001 | Lim | 271/117 |
| 6,659,449 | B2 * | 12/2003 | Kim | 271/117 |
| 7,748,697 | B2 | 7/2010 | Fujita et al. | |
| 8,459,635 | B2 | 6/2013 | Inoue | |
| 8,646,771 | B2 * | 2/2014 | Youn | 271/162 |

FOREIGN PATENT DOCUMENTS

JP 2004-292093 A 10/2004

* cited by examiner

*Primary Examiner* — Luis A Gonzalez
(74) *Attorney, Agent, or Firm* — Fitzpatrick, Cella, Harper & Scinto

(57) ABSTRACT

A sheet feeding unit includes a supporting member configured to rotatably support a rotary feeding member, a first retaining member configured to push the supporting member upward from the underside to retain the rotary feeding member at a waiting position, and a second retaining member protruding on the underside of the supporting member when the first retaining member retains the supporting member. The retention of the supporting member by the first retaining member is released in association with the mounting of a sheet storage portion in the mounting position, and then the retention of the supporting member by the second retaining member is released.

17 Claims, 9 Drawing Sheets

SHEET FEEDING UNIT AND IMAGE FORMING APPARATUS

BACKGROUND OF THE INVENTION

1. Field of the Invention

This disclosure relates to a sheet feeding unit configured to feed sheets, and an image forming apparatus provided with the sheet feeding unit.

2. Description of the Related Art

Examples of image forming apparatus such as an electrophotographic copying machine include an apparatus configured to allow a sheet feeding cassette containing sheets to be supplied to an image forming unit in a stacked manner to be inserted in and drawn out from a main body of the image forming apparatus (hereinafter, referred to as an apparatus body). In the image forming apparatus, a feeding roller moves downward to a feeding position for feeding the sheet in association with mounting of the sheet feeding cassette and comes into abutment with the sheet in the sheet feeding cassette. Then, in accordance with a feeding signal, the feeding roller rotates in a sheet feeding direction, sheets are fed to downstream from a topmost sheet in sequence.

Some of the image forming apparatus are configured in such a manner that the feeding roller moves upward to a waiting position with the sheet feeding cassette in a state of being drawn out, and the feeding roller moves downward in mid-course of completion of mounting of the sheet feeding cassette on the apparatus body. In this configuration, however, the feeding roller may be moved downward to the feed position before the completion of mounting of the sheet feeding cassette to the apparatus body, thereby coming into press-contact with a topmost sheet in the sheet feeding cassette.

In such a case, the sheet feeding cassette is pushed further inward with the feeding roller in a state of being in press-contact with the topmost sheet. Accordingly, wrinkles may be formed on the topmost sheet and the posture of the sheet gets out of alignment. In particular, in the case where the direction of movement of the sheet feeding cassette matches an axial direction of the feeding roller, a phenomenon of formation of wrinkles notably occurs because a sheet is pinched between a side regulating plate configured to regulate side ends of the sheets and the feeding roller. If the sheet is fed in a state of being out of alignment, the wrinkles of the sheet are collapsed by the roller and hence become more apparent, or the sheet are skewed. Consequently, feed failure may result.

In the related art, Japanese Patent Laid-Open No. 2004-292093 discloses an elevating mechanism of a pickup roller (feeding roller) including a sheet feeding cassette. The sheet feeding cassette includes a first lever configured to be moved in conjunction with a mounting action with respect to a main body of a sheet feed unit, a second lever configured to support the pickup roller via the first lever, and a torque limiter including a coil spring disposed on a coupling portion with respect to the first and second levers. In this sheet feed unit, if the sheet feeding cassette is inserted into the main body of the sheet feed unit, the inserted sheet feeding cassette and the first lever come into abutment with each other, and the abutment pivots the first lever in association with the movement of the sheet feeding cassette in a mounting direction. At this time, the coil spring that couples the first lever and the second lever is increased in diameter if the first lever rotates by being pressed by the sheet feeding cassette. Therefore, the pivotal movement of the first lever is not transmitted to the second lever. If the first lever is further pivoted and the support of the second lever is released, the second lever pivots downward under its own weight and the inner diameter of the coil spring is reduced. Consequently, the first and the second levers move in conjunction with each other to move the pickup roller downward.

In this manner, the sheet feeding unit of Japanese Patent Laid-Open No. 2004-292093 includes the torque limiter to retard timing of pivot of the second lever with respect to timing of abutment between the sheet feeding cassette and the first lever and thus retard timing of downward movement of the pickup roller. However, since the torque limiter used here includes the coil spring, the timing of the pickup roller moved downward is changed depends on accuracy of the coil spring.

SUMMARY OF THE INVENTION

An aspect of this disclosure provides a sheet feeding unit including an apparatus body, a sheet storage portion configured to be capable of being mounted and drawn out with respect to the apparatus body, a rotary feeding member being capable of moving, in accordance with a drawing-out action of the sheet storage portion, from a waiting position on which the rotary feeding member is apart from a sheet stored in the sheet storage portion to a feed position on which the rotary feeding member is in abutment with an upper surface of the sheet stored in the sheet storage portion to feed the sheet, and being capable of moving, in accordance with a mounting action of the sheet storage portion, from the feed position to the waiting position, and a retaining mechanism configured to retain the rotary feeding member at the waiting position in the sheet storage portion drawn out from the apparatus body, and to position the rotary feeding member at the feed position by releasing the retention of the rotary feeding member in the sheet storage portion mounted at a mounting position in the apparatus body, the retaining mechanism including a first retaining member configured to retain the rotary feeding member at the waiting position in the sheet storage portion drawn out and to release the retention in mid-course of mounting of the sheet storage portion in the apparatus body, and a second retaining member configured to retain the rotary feeding member at the waiting position in the sheet storage portion drawn out and to release the retention in response to the sheet storage portion mounted at the mounting position.

Another aspect of this disclosure provides a sheet feeding unit including an apparatus body, a sheet storage portion configured to be capable of being mounted or drawn out with respect to the apparatus body, a rotary feeding member configured to feed a sheet stored in the sheet storage portion, a supporting member configured to rotatably support the rotary feeding member, and configured to be capable of pivoting and moving the rotary feeding member between a waiting position being apart from a sheet stored in the sheet storage portion and a feed position being in abutment with an upper surface of the sheet stored in the sheet storage portion and capable of feeding the sheet, a first retaining member configured to push the supporting member upward from the underside to retain the rotary feeding member at the waiting position, a first releasing portion provided on the sheet storage portion and configured to release the retention of the supporting member by the first retaining member in mid-course of mounting of the sheet storage portion in the apparatus body, a second retaining member protruding on the underside of the supporting member when the first retaining member retains the supporting member, and a second releasing portion provided on the sheet storage portion, and configured to release the retention of the supporting member by the second retaining member in association with the movement of the sheet storage portion in the mounting direction after the retention of the supporting member by the first retaining member has been released by the first releasing portion.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

First Embodiment

Figure 1:
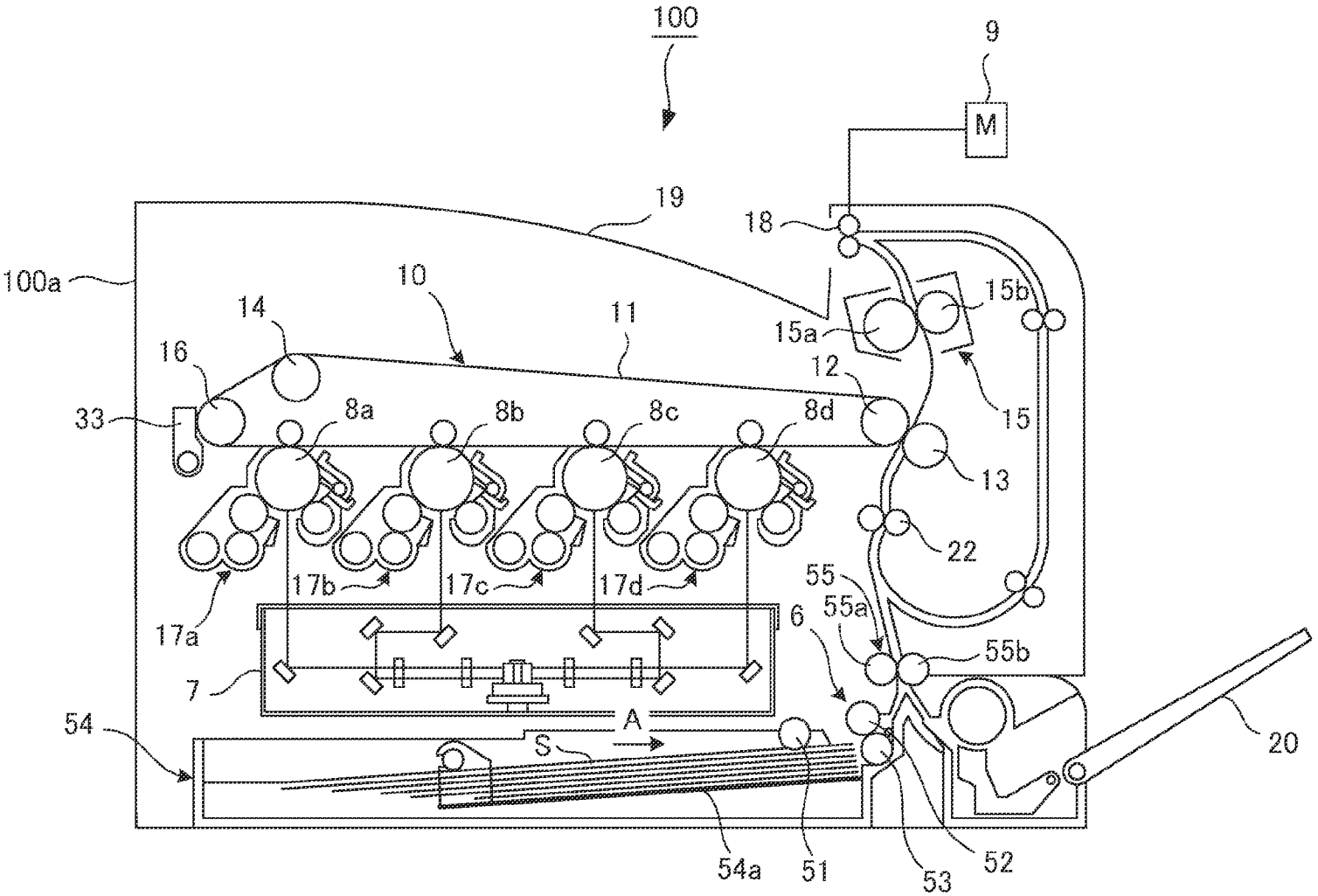
FIG. 1 is a cross-sectional view schematically illustrating the configuration of an image forming apparatus according to an embodiment.

Referring now to the drawings, an image forming apparatus such as a copying machine and a printer, and a sheet feeding unit to be mounted on the image forming apparatus will be described as examples. FIG. 1 a cross-sectional view illustrating a schematic configuration of an image forming apparatus 100 having a sheet feeding unit 6 of the embodiment mounted thereon.

<Image Forming Apparatus>

As shown in FIG. 1, the image forming apparatus 100 includes an apparatus body 100*a*. An intermediate transfer belt unit 10 is disposed in upper portion of the apparatus body 100*a*, and the sheet feeding unit 6 is disposed in a lower portion thereof. The sheet feeding unit 6 is provided with a sheet feeding cassette 54 as a sheet storage portion. The sheet storage portion contains sheets to be supplied to an image forming unit, described later. Four image forming units 17*a*, 17*b*, 17*c*, and 17*d* having photo-sensitive drums 8*a*, 8*b*, 8*c*, and 8*d*, respectively, are disposed from an upstream side to a downstream side along a direction of rotation (counterclockwise direction in FIG. 1) of an intermediate transfer belt 11 below the intermediate transfer belt unit 10. The apparatus body 100*a* configured to allow the sheet feeding cassette 54 to be mounted therein is also an apparatus body of the sheet feeding unit 6 having the containing space (see also FIG. 7) configured to allow the sheet feeding cassette 54 to be mounted therein.

The image forming units 17*a* to 17*d* are configured to form toner images of yellow, magenta, cyan, and black in this order. The photo-sensitive drums 8*a*, 8*b*, 8*c*, and 8*d* are configured respectively to be rotatably driven in a clockwise direction in FIG. 1. The intermediate transfer belt unit 10 includes the intermediate transfer belt 11 extending along a drive roller 12, a driven roller 14, and a tension roller 16 arranged at positions having a predetermined positional relationship in a tensed manner. An exposure unit 7 as latent image forming device for each of the image forming units 17*a* to 17*d* is disposed in the apparatus body 100*a* between the image forming units 17*a* to 17*d* and the sheet feeding unit 6.

A secondary transfer roller 13 disposed at a position opposing the drive roller 12 pinches the intermediate transfer belt 11 with the drive roller 12. A secondary transfer portion is formed by a transfer nip portion between the secondary transfer roller 13 and the intermediate transfer belt 11. A bias is applied to the secondary transfer portion via the secondary transfer roller 13, so that the toner images in four colors on the intermediate transfer belt are secondarily transferred to a sheet S fed from the sheet feeding unit 6 and conveyed by a registration roller pair 22. A belt cleaning unit 33 is disposed on a surface of the intermediate transfer belt at a position opposing the tension roller 16.

A fixing unit 15 having a fixing roller 15*a* and a pressing roller 15*b* is arranged above the secondary transfer portion. The sheet S having the toner image transferred thereto is conveyed to a fixing nip portion between the fixing roller 15*a* and the pressing roller 15*b*, is heated and pressurized by the both rollers 15*a* and 15*b*, and the toner image transferred thereto is fixed to the surface thereof. The image forming units 17*a* to 17*d* and the fixing unit 15 constitute an image forming portion configured to form an image on the sheet S fed by the sheet feeding unit 6 in the present embodiment.

The sheet feeding unit 6 feeds the sheet S in the sheet feeding cassette 54 (in the sheet storage portion) by means of a pickup roller 51 as a rotary feeding member. The sheet S is fed one by one via a feed roller 52 and a retard roller 53, and is conveyed to the registration roller pair 22 via a conveyance roller pair (pulling-out roller pair) 55 including conveyance rollers 55*a* and 55*b*. The sheet is stopped once in a state of being abutted against a nip of the registration roller pair 22. Subsequently, the sheet S is fed into the secondary transfer portion at predetermined timing by the registration roller pair 22. The sheet S having the toner image transferred thereto at the secondary transfer portion is subjected to fixation of the toner image by the fixing unit 15, and then is discharged to a discharged sheet tray 19 via a sheet discharge roller pair 18 downstream.

Figure 2A:
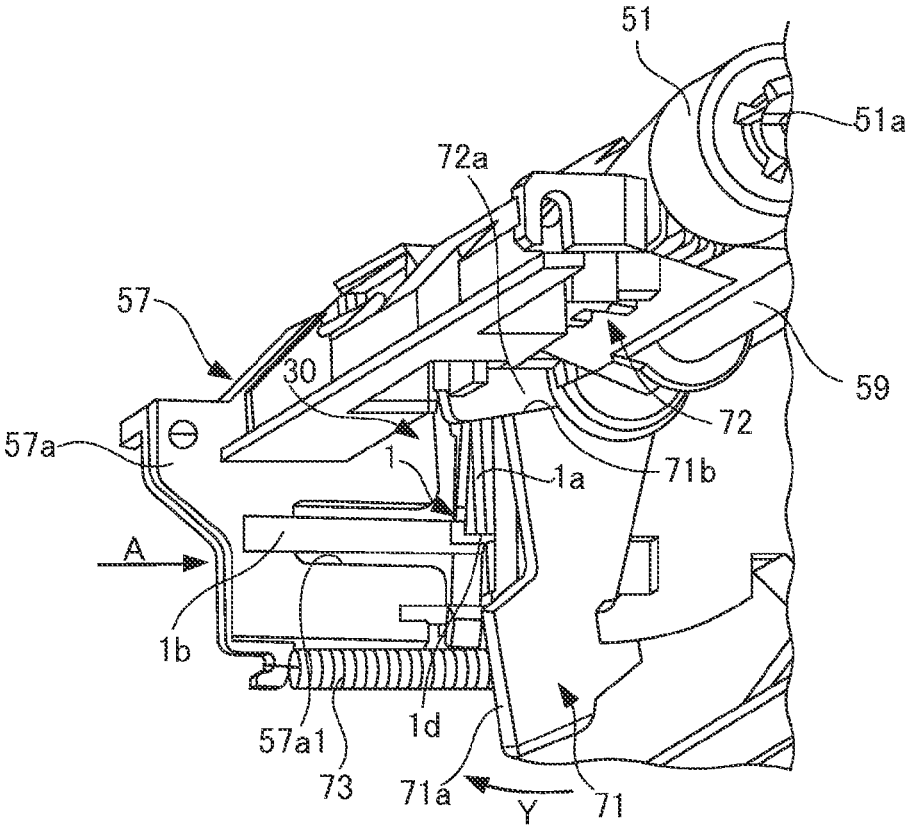
FIG. 2A is a perspective view of part of a sheet feeding unit of the embodiment with a sheet feeding cassette in a drawn-out state.
Figure 2B:
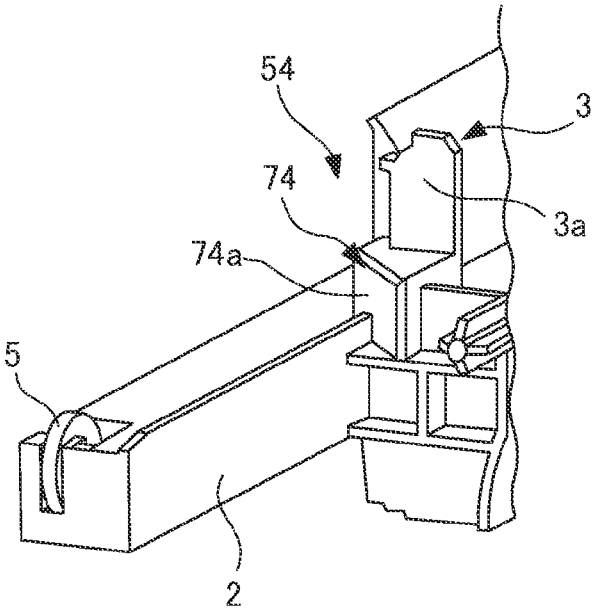
FIG. 2B is a perspective view of part of the sheet feeding cassette illustrating in an enlarged scale.
Figure 3A:
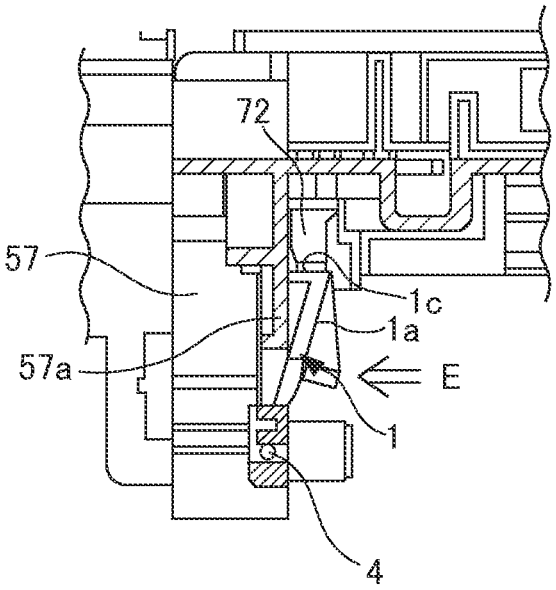
FIG. 3A is a plan view of part of a sheet feeding unit of the embodiment with a sheet feeding cassette in a drawn-out state.
Figure 3B:
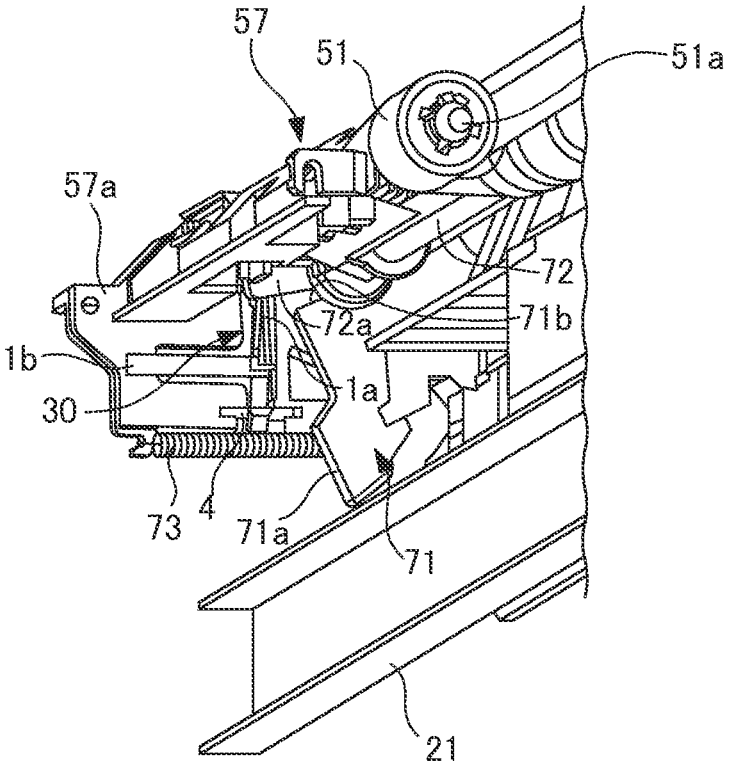
FIG. 3B is a perspective view of part of the sheet feeding unit illustrated in FIG. 3A.
Figure 4A:
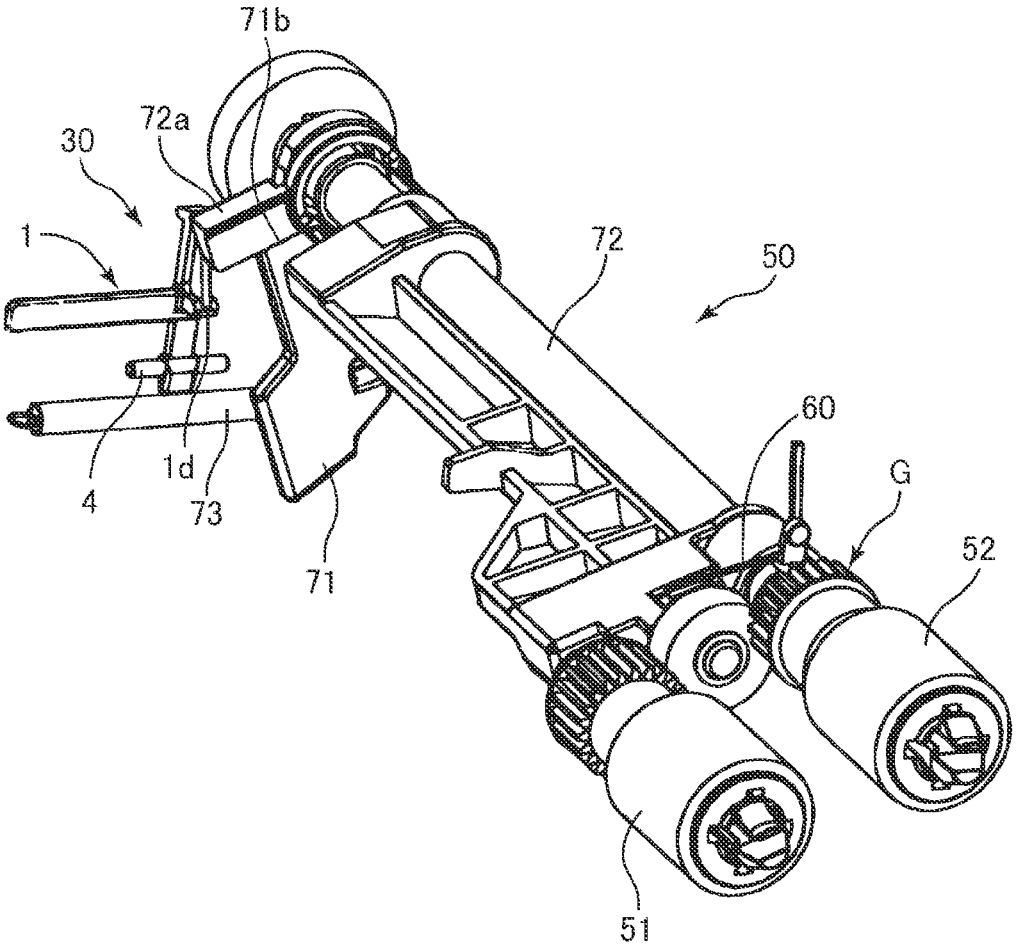
FIG. 4A is a perspective view illustrating a configuration of a supporting member configured to pivotally support a pickup roller.
Figure 4B:
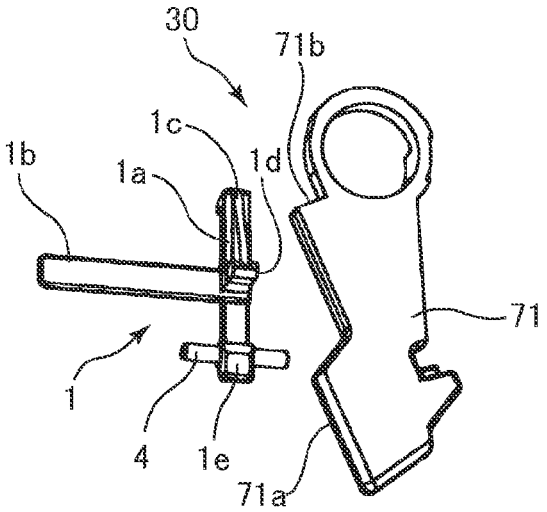
FIG. 4B is a perspective view of a retaining mechanism configured to retain the pickup roller at a waiting position.
Figure 5A:
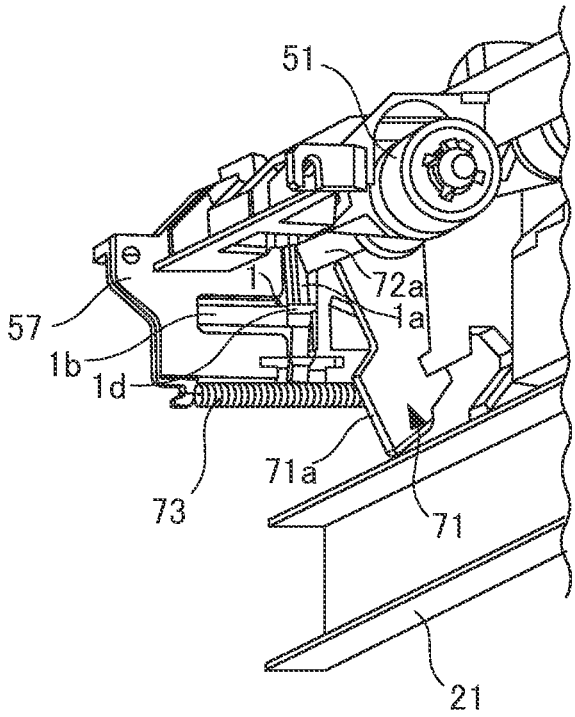
FIG. 5A is a perspective view of part of a sheet feeding unit of the embodiment with a sheet feeding cassette in a state corresponding to the mounted state.
Figure 5B:
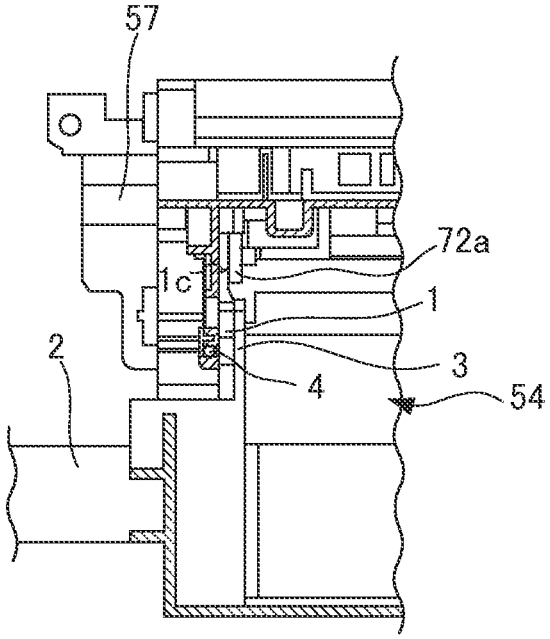
FIG. 5B is a side view of part of the sheet feeding unit illustrated in FIG. 5A.
Figure 6A:
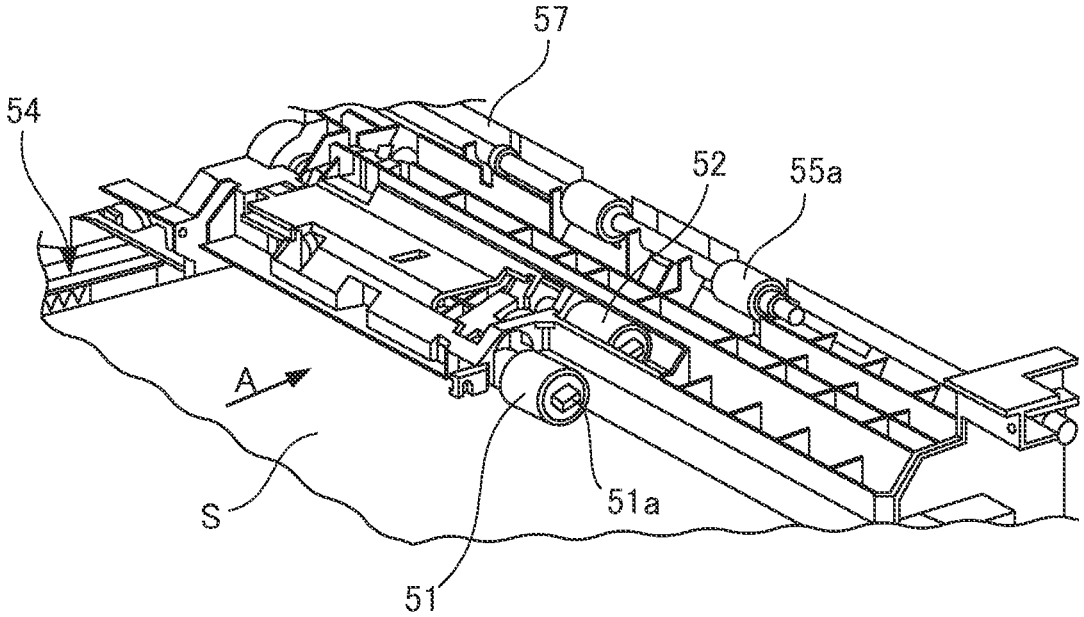
FIG. 6A is a perspective view of the sheet feeding unit of the embodiment in a state of being viewed from above.
Figure 6B:
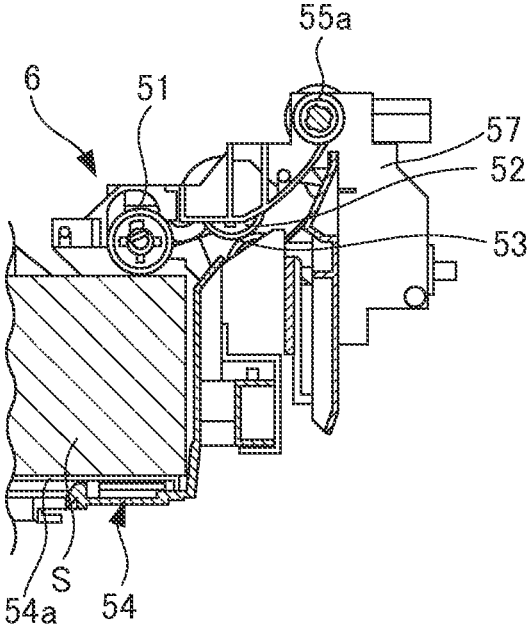
FIG. 6B is a cross-sectional view of part of FIG. 6A illustrating in an enlarged scale.
Figure 7:
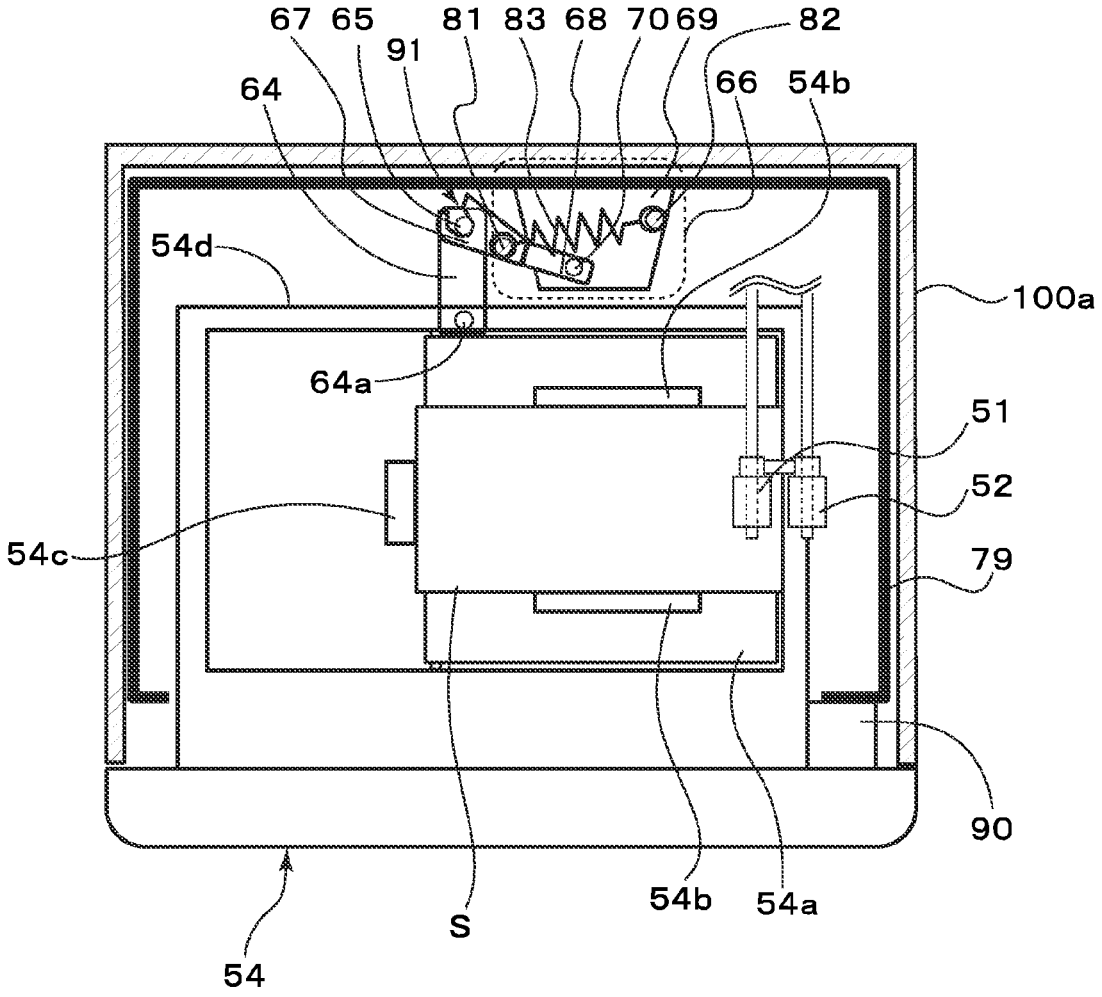
FIG. 7 is a plan view illustrating a mounted state of the sheet feeding cassette of the embodiment on the apparatus body.

Subsequently, detailed configurations of the sheet feeding unit 6 and the sheet feeding cassette 54 according to the embodiment will be described with reference to FIG. 2A, FIG. 2B to FIG. 7. FIG. 2A is a perspective view of part of the sheet feeding unit 6 with the sheet feeding cassette 54 illustrated in a drawn-out state, and FIG. 2B is a perspective view of part of the sheet feeding cassette 54 illustrated in an enlarged scale. FIG. 3A and FIG. 3B are a plan view and a perspective view of part of the sheet feeding unit 6 with the sheet feeding cassette 54 in a drawn-out state, respectively. FIG. 4A is a perspective view of a configuration of a supporting member configured to pivotally support a pickup roller, and FIG. 4B is a perspective view of a retaining mechanism configured to retain the pickup roller at a waiting position. FIG. 5A and FIG. 5B are a perspective view and a side view of part of the sheet feeding unit 6 with a sheet feeding cassette in a mounted state, respectively. FIG. 6A and FIG. 6B are a perspective view and a partly enlarged cross sectional view of the sheet feeding unit 6 viewed from above, respectively. FIG. 7 is a plan view illustrating a state of the apparatus body having the sheet feeding cassette 54 mounted thereon.

The sheet feeding cassette 54 as the sheet storage portion is provided on the apparatus body 100*a*. As illustrated in FIG. 7, the sheet feeding cassette 54 includes a stacking plate 54*a* configured to allow the sheets S to be stacked thereon, side regulating members 54*b* and 54*b* configured to regulate side ends of the sheets stacked on the stacking plate 54*a*, and a rear end regulating member 54*c* configured to regulate rear ends of the sheets. The sheet feeding cassette 54 is supported by guide rails 21 (illustrated in FIG. 3B) so as to be movable between a mounting position for feeding the sheets and a drawn-out position drawn to the outside from the mounting position.

The sheet feeding cassette 54 is drawn out from the apparatus body 100*a* for replenishment of sheets or the like. The sheet feeding cassette 54 may either be configured to be restricted from being drawn by a regulating unit, not illustrated, in mid-course of retraction at a position which allows replenishment of sheets or be configured to be drawn out completely from the apparatus body 100*a*. The sheet feeding cassette 54 is provided so as to be drawn out in a direction orthogonal to a feeding direction of sheets (sheet feeding direction) by the sheet feed unit including the feed roller 52, the retard roller 53, and the pickup roller 51.

The sheet feeding unit includes a retracting device for retracting the sheet feeding cassette 54 into the apparatus body 100*a*. The retracting device will be described with reference to FIG. 7. A swing arm 64 having a swing pin 65 at a distal end portion thereof is supported by a side wall 54*a* on a back side of the sheet feeding cassette 54 so as to be capable of swinging about a shaft 64*a* as a supporting point. A retracting unit 66 as a retracting device configured to retract the sheet feeding cassette 54 into the apparatus body 100*a* is arranged on a back side inner wall surface of the apparatus body 100*a*. The retracting unit 66 includes a retracting unit base 69 and a retracting hook 67 at a distal end thereof, and includes a retracting arm 68 supported on the retracting unit base 69 so as to be capable of pivoting about a supporting point 70.

A concaved portion 91 configured to engage the swing pin 65 of the swing arm 64 is formed on the retracting hook 67 of the retracting arm 68. An arm pin 81 is provided between the retracting hook 67 of the retracting arm 68 and the supporting point 70. A tension spring 83 engages the base pin 82 provided on the retracting unit base 69 at one end thereof and the other end of the tension spring 83 engages the arm pin 81. The retracting arm 68 is biased by the tension spring 83 so as to pivot about the supporting point 70.

At the time of pulling out the sheet feeding cassette 54, the retracting arm 68 pivots counterclockwise from the position illustrated in FIG. 2A and FIG. 2B about the supporting point 70 in a pulling-out direction against the tension spring 83 while the concaved portion 91 engages the swing pin 65. Subsequently, if the sheet feeding cassette 54 is further pulled out, the retracting arm 68 pivots until the engagement of the swing pin 65 with the concaved portion 91 is released.

When the sheet feeding cassette 54 is mounted in the apparatus body 100*a*, retracting arm 68 is positioned so that the swing pin 65 of the swing arm 64 enters the concaved portion 91 of the retracting hook 67. Therefore, when the sheet feeding cassette 54 is inserted into the apparatus body 100*a*, the swing pin 65 enters the concaved portion 91 of the retracting hook 67. If the sheet feeding cassette 54 is further pushed inward, the retracting arm 68 is pressed toward the back side via the swing pin 65 and the retracting hook 67.

Accordingly, the retracting arm 68 pivots clockwise against the tension spring 83 about the supporting point 70. When the retracting arm 68 pivots to a predetermined position, a biasing force is applied to the retracting arm 68 by the tension spring 83 and hence the retracting arm 68 pivots clockwise. The concaved portion 91 of the retracting hook 67 engages the swing pin 65. Consequently, if the retracting arm 68 is pivoted by the tension spring 83, the sheet feeding cassette 54 is mounted by the tension spring 83 via the retracting arm 68.

The sheet feeding cassette 54 is provided with a stopper 90. When the sheet feeding cassette 54 is mounted in the apparatus body 100*a*, the stopper 90 abuts against a main body frame 79 of the apparatus body 100*a*, so that the positioning of the sheet feeding cassette 54 in the apparatus body 100*a* is achieved. In other words, when the sheet feeding cassette 54 is retracted into the apparatus body 100*a* by the retracting device, the stopper 90 of the sheet feeding cassette 54 abuts against the main body frame 79, and the sheet feeding cassette 54 is stopped at a mounting position. When the sheet feeding cassette 54 is positioned at the mounting position, sheets are allowed to be fed from the sheet feeding cassette 54 by the pickup roller 51.

The sheet feeding unit 6 includes a supporting frame 57 fixed to the apparatus body 100*a* (see FIG. 1) as illustrated in FIG. 6A and FIG. 6B, and the feed roller 52, the retard roller 53, and the conveyance roller 55*a* are supported by the supporting frame 57 respectively. The feed roller 52 is fixed to an end of a feeding drive shaft 59 (FIG. 2A) connected to a drive source such as a motor, not illustrated. The pickup roller 51 is mounted on a shaft 51*a* rotatably provided on a supporting member 72 supported by the feeding drive shaft 59 so as to be capable of swinging. The shaft 51*a* is arranged in parallel with the feeding drive shaft 59, and the feeding drive shaft 59 and the shaft 51*a* are coupled with a gear train G (see FIG. 4A).

In this configuration, a drive force from a drive source such as the motor, not illustrated, is transmitted to the feeding drive shaft 59 and, in addition, the drive force is transmitted to the shaft 51*a* via the gear train, so that the pickup roller 51 is rotated. The pickup roller 51 comes into abutment with an upper surface of the topmost sheet of the sheets S stacked on the stacking plate 54*a* pivotally supported in the sheet feeding cassette so as to be (movable upward and downward), and is rotated by a rotation of the shaft 51*a*, so that the sheets are fed. Accordingly, the pickup roller 51 feeds the topmost sheet toward the downstream of the sheet feeding direction (the direction indicated by an arrow A).

The pickup roller 51 is configured to be movable from a feed position (see FIG. 5A) to a waiting position (see FIG. 3B) in accordance with the drawing action of the sheet feeding cassette 54. At the feed position, the pickup roller 51 abuts against the sheet S in the sheet feeding cassette and feeds the sheet S. At the waiting position, the pickup roller 51 waits in a state of being apart from the sheet S. The pickup roller 51 is configured to be movable from the waiting position to the feed position on which the pickup roller 51 is in abutment with an upper surface of the sheet S to feed the sheet in accordance with the mounting action of the sheet feeding cassette 54. The pickup roller 51 lifts the supporting member 72 to move from the feed position to the waiting position. A biasing mechanism 50, described later, is provided on the sheet feeding unit for bringing the pickup roller 51 into press contact with the upper surface of the sheets S stacked on the stacking plate 54*a*.

The feed roller 52 conveys the sheet S fed by the pickup roller 51 to the downstream of the sheet S. The retard roller 53 is coupled to a torque limiter, not illustrated, abuts against the feed roller 52 to form a separation nip portion, and separates the sheets S fed from the pickup roller 51 one by one at the separation nip portion.

As illustrated in FIG. 4A and FIG. 4B, the biasing mechanism 50 for bringing the pickup roller 51 into press contact with the upper surface of the sheet S on the stacking plate 54*a*, is provided. The biasing mechanism 50 includes a supporting member 72 pivotally mounted on the feeding drive shaft 59, and a sheet feeding pressure spring (torsion coil spring) 60 arranged between the feeding drive shaft 59 and the supporting member 72 and configured to bias the supporting member 72. The supporting member 72 rotatably supports the shaft 51*a* of the pickup roller 51, and the supporting member 72 is biased downward by the resilient force of the sheet feeding pressure spring 60, and hence brings the pickup roller 51 into press contact with the upper surface of the sheet S on the stacking plate 54*a*.

As illustrated in FIG. 2A, a sheet feeding unit 6 is provided with a retaining mechanism 30 configured to retain the pickup roller 51 at the waiting position, and release the retention of the pickup roller 51 in accordance with the mounting of the sheet feeding cassette 54 to the apparatus body. The retaining mechanism includes a plate-shaped first retaining member (retaining plate) 71 and a second retaining member 1 arranged on the back side in the mounting direction of the sheet feeding cassette 54 with respect to the first retaining member 71 and being capable of retaining the supporting member 72. The first retaining member 71 retains and is capable of retaining the supporting member 72. More specifically, the first retaining member 71 is supported by the apparatus body 100*a* so as to be capable of pivoting in the direction orthogonal to the mounting direction of the sheet feeding cassette (sheet storage portion) 54 on a side nearer to a front side of the apparatus body 100*a* in the mounting direction than a leading edge position of the sheet storage portion located at the mounting position. In other words, the first retaining member 71 is a retaining plate provided so as to be capable of pivoting in the same direction as the supporting member 72, and configured to retain the pickup roller 51 at the waiting position by pushing up the supporting member 72 so as to pivotally protrude toward the containing space of the sheet feeding cassette 54 by the biasing force of the tension coil spring 73, described later. The second retaining member 1 is supported by the apparatus body 100*a* so as to be capable of pivoting in the mounting direction of the sheet feeding cassette 54 on a side nearer to a back side of the apparatus body 100*a* in the mounting direction than the first retaining member 71. Furthermore, the retaining mechanism 30 includes a first releasing portion 74 and a second releasing portion 3 configured to release the retention at the waiting position of the pickup roller 51 by the first retaining member 71 and the second retaining member 1 (see FIG. 2B).

When the first retaining member 71 retains the supporting member 72, the supporting member 72 retains the pickup roller 51 at the waiting position against the resilient force of the sheet feeding pressure spring 60. When the first retaining member 71 releases the retention of the supporting member 72, the pickup roller 51 becomes a state of being movable to the feed position by the sheet feeding pressure spring 60. In the same manner, when the second retaining member 1 retains the supporting member 72, the supporting member 72 retains the pickup roller 51 at the waiting position against the resilient force of the sheet feeding pressure spring 60. When the second retaining member 1 releases the retention of the supporting member 72, the pickup roller 51 becomes a state of being movable to the feed position by the sheet feeding pressure spring 60.

The first retaining member (retaining plate) 71 is formed into a plate shape, is supported by the feeding drive shaft 59, and is supported so as to be capable of pivoting in the direction orthogonal to the mounting direction of the sheet feeding cassette 54 with respect to the apparatus body. The first retaining member 71 is resiliently biased in the clockwise direction (the direction indicated by an arrow Y) in FIG. 2A by a tension coil spring 73 as the resilient member provided between the first retaining member 71 and the supporting frame 57. With the sheet feeding cassette 54 in the drawn-out state, the first retaining member 71 includes an upper edge portion (push-up portion) 71*b* configured to retain the pickup roller 51 at the waiting position by abutting against the supporting member 72 from the underside.

If the underside of the first retaining member 71 is pressed by the sheet feeding cassette 54 to be mounted, the first retaining member rotates in a counterclockwise direction (a direction opposite to the direction indicated by the arrow Y) in FIG. 2A against the resilient force of the tension coil spring 73. Accordingly, the upper edge portion 71*b* of the first retaining member 71 moves away from the supporting member 72 and releases the retention of the pickup roller 51, and the pickup roller 51 abuts against the upper surface of the sheet in the sheet feeding cassette 54 by a predetermined feeding pressure by the resilient force of the sheet feeding pressure spring 60.

The second retaining member 1 has a configuration of rotating in association with the mounting of the sheet feeding cassette 54, and this configuration will be described below. As illustrated in FIG. 2A, FIG. 3A, FIG. 3B, FIG. 4A, FIG. 4B, FIG. 5A and FIG. 5B, the second retaining member 1 is mounted on the supporting frame 57 so as to be capable of pivoting about a pivot supporting shaft 4 as a supporting point. The second retaining member 1 is provided so as to pivotally protrude from a side wall 57*a* on the rear side of the supporting frame 57 (that is, the back side of the apparatus body 100*a* in the mounting direction) about a lower end as a supporting point, and is restricted by a rotation stopper, not illustrated, so as not to pivot clockwise beyond a protruding pivotal position illustrated in FIG. 3A.

If a protruding portion (abutment portion) 1*d* of the second retaining member 1 is pressed from the mounting direction of the sheet feeding cassette 54, the second retaining member 1 pivots and retracts into the interior of the side wall 57*a*. The second retaining member 1 retains the pickup roller 51 at the waiting position by abutting against the supporting member 72 from the underside at a retaining position protruding from the side wall 57*a* as illustrated in FIG. 3A.

The second retaining member 1 will be described in detail. The second retaining member 1 is composed of a resin spring formed of a synthetic resin material. As illustrated in FIG. 4B, the second retaining member 1 includes a main body portion (main body of a retaining portion) 1*a* extending in the vertical direction, an arm portion 1*b* formed so as to extend longitudinally in an arm shape from the main body portion 1*a* toward an upstream side (left side) in the sheet feeding direction (a direction indicated by an arrow A in FIG. 2A) and configured to engage the side wall 57*a* of the supporting frame 57, a mounting portion 1*e* configured to mount the main body portion 1*a* so as to be capable of pivoting in the mounting direction and the drawing-out direction with respect to the side wall 57*a*, and the abutment portion 1*d* configured to abut against an abutting surface 3*a* of the second releasing portion 3 of the sheet feeding cassette 54.

The main body portion 1*a* is provided with a hook-shaped retaining claw portion 1*c* formed on an upper end thereof, and the retaining claw portion 1*c* resiliently protrudes from the side wall 57*a* of the supporting frame 57 by resin spring properties provided by the arm portion 1*b*. The retaining claw portion 1*c* abuts against a protruding shaped supporting portion 72*a* provided on the supporting member 72 from the underside to retain the supporting member 72, and maintains the pickup roller 51 at the waiting position. If the second retaining member 1 is pressed and the retaining claw portion 1*c* retracts to the inside of the side wall 57*a*, support of the supporting portion 72*a* of the supporting member 72 is released, whereby the supporting member 72 swings with a resilient force of the sheet feeding pressure spring 60, so that the pickup roller 51 is lowered to the feed position. In other words, the arm portion 1*b* serves as a biasing portion configured to bias the main body portion 1*a* resiliently in the drawing-out direction of the sheet feeding cassette 54 so that the retaining claw portion 1*c* engages the supporting portion 72*a* of the supporting member 72 to bring the pickup roller 51 to be held at the waiting position. If the abutment portion 1*d* is pressed by the abutting surface 3*a* of the second releasing portion 3 in the mounting direction, the second retaining member 1 pivots in the mounting direction toward a concaved portion (retracting hole portion) 57*a*1 formed on the side wall 57*a*, and hence the engagement with the supporting member 72 by the retaining claw portion 1*c* is released.

The sheet feeding cassette 54 is restricted by the above-described stopper 90 at the time of being mounted into the apparatus body 100*a*, whereby the mounting position is fixed. A releasing position is set so that the release of the support of the supporting member 72 by the retaining claw portion 1*c* of the second retaining member 1 is performed before the sheet feeding cassette 54 is restricted by the stopper 90 and hence is stopped.

"Before the sheet feeding cassette 54 is restricted by the stopper 90 and hence is stopped" is a concept including a moment when the sheet feeding cassette 54 is mounted at the mounting position. In the embodiment, "in response to the sheet feeding cassette 54 mounted at the mounting position (when the sheet feeding cassette 54 is mounted at the mounting position)" is a concept including not only the moment strictly when the sheet feeding cassette 54 is mounted at the mounting position, but also a position immediately before the sheet feeding cassette 54 is practically mounted at the mounting position. Also, in the embodiment, a period after the retention by the second retaining member 1 is released and the sheet feeding cassette 54 reaches the mounting position until timing when the rotary feeding member takes the feed position is also included in a concept when the sheet feeding cassette 54 is mounted at the mounting position thereof. Therefore, the above-described releasing position needs only to be set so that the retention of the supporting member 72 by the second releasing portion 3 is started to be released before the position of the sheet feeding cassette 54 in the mounting direction is restricted by the stopper 90, and the retention of the supporting member 72 by the second retaining member 1 is released when the position of the sheet feeding cassette 54 in the mounting direction by the stopper 90 to move the pickup roller 51 to the feed position.

Subsequently, a configuration of the sheet feeding cassette 54 will be described. FIG. 2B illustrates a portion corresponding to one side in the direction of insertion of the sheet feeding cassette 54 into the apparatus body 100*a* (back side on the right side when facing FIG. 1).

The sheet feeding cassette 54 is configured to be mountable and drawable with respect to the apparatus body 100*a*, provided that the front side and back side direction in FIG. 1 is the direction of insertion and drawing-out. The sheet feeding cassette 54 is provided so as to allow insertion and drawing-out with respect to the apparatus body of the sheet feeding unit 6 (or the apparatus body of the image forming apparatus), and includes guided portions 2 guided by the guide rails 21 (see FIG. 3B) on both the right and left sides (only one side is illustrated in FIG. 2B). Guide rollers 5 rotating in the guide rails 21 and configured to smoothen the mounting and the drawing out of the sheet feeding cassette 54 with respect to the apparatus body 100*a* are provided at upper portions of the distal ends of the guided portions 2.

The sheet feeding cassette 54 is provided with the second releasing portion 3 having a flat surface orthogonal to the mounting direction of the sheet feeding cassette 54 in order to push the second retaining member 1 provided on the apparatus body side inward against the biasing force thereof. When mounting the sheet feeding cassette 54 on the apparatus body 100*a*, the second releasing portion 3 is provided so as to pivot the second retaining member 1 in the releasing direction and release the retention of the supporting member 72 at the time point when the mounting of the sheet feeding cassette 54 with respect to the apparatus body 100*a* is completed.

The second releasing portion 3 is configured to be capable of releasing the retention of the supporting member 72 reliably by pressing the retaining claw portion 1*c* inward against the biasing force immediately before being mounted at the mounting position of the sheet feeding cassette 54. In other words, the second releasing portion 3 is configured to press the second retaining member 1 by the second releasing portion 3 reliably at a time point immediately before the completion of the mounting when the sheet feeding cassette 54 is mounted in the apparatus body 100*a*, and release the retention of the supporting member 72 by the retaining mechanism 30 adequately when the mounting of the sheet feeding cassette 54 is at the mounting position.

The sheet feeding cassette 54 is provided with a first releasing portion 74 having an inclined surface 74*a* configured to come into sliding contact with the pressed portion 71*a* of the first retaining member 71 and pivot the first retaining member 71 counterclockwise in FIG. 2A against the resilient biasing force of the tension coil spring 73 as the resilient member. The inclined surface 74*a* of the first releasing portion 74 moves the first retaining member 71 in the releasing direction in mid-course of movement in the mounting direction into the interior of the apparatus body of the sheet feeding cassette 54 to release the retention of the supporting member 72. Even though the retention of the supporting member 72 by the first retaining member 71 is released by the first releasing portion 74 in association with the mounting of the sheet feeding cassette 54 into the apparatus body 100*a*, the retention of the supporting member 72 is maintained by the retaining claw portion 1*c*.

In addition, by mounting the sheet feeding cassette 54, the retention of the supporting member 72 by the second retaining member 1 is released. In other words, the positions of the first releasing portion 74 and the second releasing portion 3 provided on the sheet feeding cassette 54 are shifted in the fore-and-aft direction in the mounting direction of the sheet feeding cassette 54. The first releasing portion 74 firstly releases the retention by the first retaining member 71, and subsequently, the second releasing portion 3 releases the retention by the second retaining member 1.

FIG. 2A illustrates the sheet feeding cassette 54 being drawn out, and the first releasing portion 74 being out of contact with the first retaining member 71. In this state, the first retaining member 71 is pivoted in the clockwise direction in FIG. 2A by a biasing force of the tension coil spring 73, and retains the pickup roller 51 at the waiting position, namely, the lifted position. At this time, the supporting member 72 is pushed upward by the upper edge portion (push-up portion) 71*b* of the first retaining member 71, and hence the pickup roller 51 retained by the supporting member 72 is retained at the waiting position.

With the sheet feeding cassette 54 being drawn out, the second retaining member 1 protrudes forward from the side wall 57*a* on the rear side of the supporting frame 57 as illustrated in FIG. 3A. The supporting member 72 is pushed up by the retaining claw portion 1*c* of the second retaining member 1. In this manner, with the sheet feeding cassette 54 being drawn out from the apparatus body, the supporting member 72 is retained at a state of being lifted up by the first retaining member 71 and the second retaining member 1, so that the pickup roller 51 is retained at the waiting position.

An action of the retaining mechanism 30 when the sheet feeding cassette 54 is drawn out from the apparatus body will be described. When the sheet feeding cassette 54 is started to be drawn out, the retaining claw portion 1*c* of the second retaining member 1 starts protruding forward from the side wall 57*a* by the resilient force and stops by abutting against the side surface of the supporting portion 72*a* of the supporting member 72. When the sheet feeding cassette 54 is further pulled out, the first retaining member 71 moves along the inclined surface 74*a* of the first releasing portion 74 of the sheet feeding cassette 54, and pivots in the direction indicated by the arrow Y in FIG. 2A by the resilient force of the tension coil spring 73. Accordingly, the upper edge portion 71*b* of the first retaining member 71 pushes up the supporting portion 72*a* from the underside of the supporting member 72.

When the supporting portion 72*a* of the supporting member 72 is pushed up by the upper edge portion 71*b* of the first retaining member 71, the retaining claw portion 1*c* of the second retaining member 1 moves to the underside of the supporting portion 72*a* of the supporting member 72. Accordingly, retention of the pickup roller 51 at the waiting position is achieved by the first retaining member 71 and the second retaining member 1. In this manner, the first retaining member 71 has a function of pushing up the supporting member 72 and moving the pickup roller 51 to the waiting position. The second retaining member 1 has a function of releasing the retention of the supporting member 72 immediately before the mounting position of the sheet feeding cassette 54 with respect to the apparatus body and lowering the pickup roller 51 to the feed position.

<Operation of Sheet Feeding Unit>

Subsequently, effects of the sheet feeding unit 6 of the embodiment will be described. As illustrated in FIG. 6A and FIG. 6B, the pickup roller 51 abutting against the topmost sheet of the sheets S in the sheet feeding cassette 54 feeds the sheets S to a separation nip portion between the feed roller 52 and the retard roller 53. Accordingly, a single sheet S separated at the separation nip portion is conveyed downstream by the conveyance roller pair 55 including the conveyance rollers 55*a* and 55*b*, and is discharged onto the discharged sheet tray 19 in a state having a toner image fixed thereto through the respective processes described above.

At the time of replenishment and replacement of the sheet S, the sheet feeding cassette 54 is drawn out from the apparatus body 100*a* by a user or the like. With the sheet feeding cassette 54 drawn out from the apparatus body 100*a*, the first retaining member 71 pivots in the clockwise direction in FIG. 2A by the biasing force of the tension coil spring 73 to stop as illustrated. Therefore, the supporting member 72 is pushed upward by the first retaining member 71, and the pickup roller 51 is positioned at the waiting position.

In this case, as illustrated in FIG. 2A and FIG. 3A, the supporting member 72 is pushed up to a higher position than the retaining claw portion 1*c* of the second retaining member 1 by the first retaining member 71. The second retaining member 1 takes a protruding posture of protruding the retaining claw portion 1*c* toward the underside of the supporting member 72 by the resin spring function of the arm portion 1*b* and is restricted so as not to protrude further by the rotation stopper (not illustrated).

With the sheet feeding cassette 54 pulled out and the pickup roller 51 being at the waiting position, the first retaining member 71 pushes up the supporting member 72 until the sheet feeding cassette 54 is inserted and the first releasing portion 74 comes into sliding contact with the pressed portion 71*a* of the first retaining member 71. As illustrated in FIG. 3A, the second retaining member 1 retains the supporting member 72 on an upper position until the second releasing portion 3 of the sheet feeding cassette 54 abuts against the second retaining member 1. Accordingly, the pickup roller 51 is retained at the waiting position as illustrated in FIG. 3B.

After the sheets S has been stored in the sheet feeding cassette, the sheet feeding cassette 54 is pushed inward and is mounted at the mounting position of the apparatus body 100*a*. At this time, the first releasing portion 74 of the sheet feeding cassette 54 comes into sliding contact with the pressed portion 71*a* of the first retaining member 71, so that the first retaining member 71 pivots toward the downstream side (the direction indicated by the arrow A) of the sheet feeding direction and moves away from the supporting member 72. In addition, the pressed portion 71*a* is kept in sliding contact with the rear side of the inclined surface 74*a* of the first releasing portion 74, the first retaining member 71 is restricted from returning in the biasing direction of the tension coil spring 73 with the sheet feeding cassette 54 in a state of being mounted thereon.

Here, in order to reduce the stress applied to the first retaining member 71, a sliding contact angle between the first retaining member 71 and the inclined surface 74*a* is preferably set to a range between 31 to 45 degrees. More preferably, the sliding contact angle is not larger than 30 degrees in order to further reduce an operation force.

If the first releasing portion 74 comes into sliding contact with the first retaining member 71, in association with the movement of the sheet feeding cassette 54 in the direction of insertion, the first retaining member 71 pivots about the feeding drive shaft 59 as a supporting point along the inclined surface 74*a* of the first releasing portion 74. Therefore, the supporting member 72 pushed up by the first retaining member 71 by the clockwise pivot of the first retaining member 71 pivots downward about the feeding drive shaft 59 as a supporting point. Accordingly, the pickup roller 51 retained by the supporting member 72 tries to move downward. However, since the retaining claw portion 1*c* of the second retaining member 1 protrudes toward the underside, the supporting member 72 is retained by the retaining claw portion 1*c*.

Then, at the time of completion of the mounting of the sheet feeding cassette 54 to the apparatus body 100*a*, the second releasing portion 3 on the sheet feeding cassette side abuts against a portion of intersection between the main body portion 1*a* and the arm portion 1*b* of the second retaining member 1, whereby the retaining claw portion 1*c* is pushed inward toward the supporting frame 57 (direction indicated by an arrow E in FIG. 3A). Accordingly, the retention of the supporting member 72 by the retaining claw portion 1*c* is released, and hence the supporting member 72 pivots so that the pickup roller 51 moves downward to the feed position (counterclockwise in FIG. 3B).

In this manner, the pickup roller 51 moves downward to the feed position in association with the action of the supporting member 72 (FIG. 5A and FIG. 5B), and abuts against the topmost sheet in the sheet feeding cassette 54 into a state of being capable of feeding the sheet.

According to the embodiment described thus far, with the provision of the second retaining member 1 in the sheet feeding unit 6 and the second releasing portion 3 in the sheet feeding cassette 54, the movement of the pickup roller 51 to the feed position can be restricted reliably until the completion of the mounting of the sheet feeding cassette 54.

Therefore, the pickup roller 51 starts moving downward only upon completion of the mounting of the sheet feeding cassette in the apparatus body 100*a*. Therefore, even with a configuration as simple as possible and even while avoiding the problem of an increase in size of the apparatus or the like, a problem of the topmost sheet becoming out of alignment with the stacked sheets at the time of mounting the sheet feeding cassette 54 in the apparatus body 100*a* is reliably avoided. Then, with the simplified apparatus configuration, realization of a low cost and space saving sheet feeding unit 6 is enabled. Since the pickup roller 51 takes the feed position from the waiting position only when the second retaining member 1 is pressed in the mounting direction by the second releasing member, the pickup roller 51 is positioned at the feed position only after the sheet feeding cassette 54 is positioned at the mounting position.

In this embodiment, application of a biasing force to the second retaining member 1 is achieved by elongating part of the second retaining member 1 as the arm portion 1*b* and making the arm portion 1*b* function as a resin spring. However, this disclosure is not limited thereto, and a spring member such as a torsion coil spring may be used.

Second Embodiment

Figure 8A:
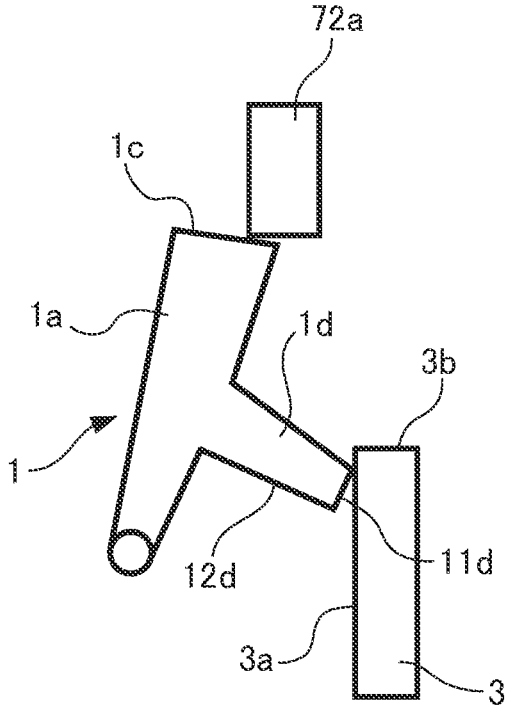
FIG. 8A is a plan view of a second retaining member abutting against a second releasing portion of a second embodiment.
Figure 8B:
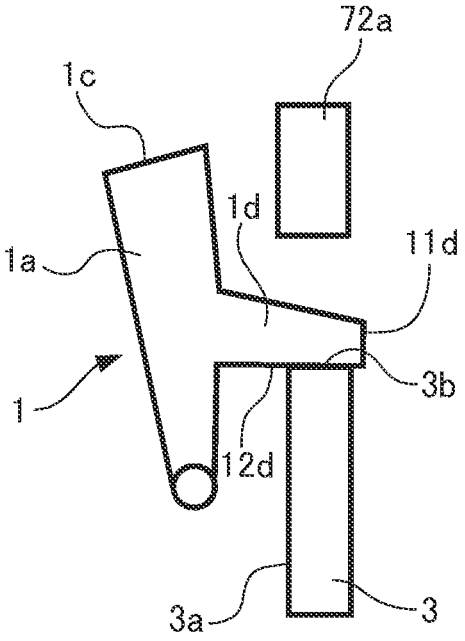
FIG. 8B is a plan view of a relationship between the second retaining member and the second releasing portion after the second retaining member has released the supporting member.

Subsequently, the second embodiment will be described. Description of the same configuration as the above-described first embodiment will be omitted. FIG. 8A is a plan view illustrating a state of the second retaining member 1 in abutment with the second releasing portion 3 on the sheet feeding cassette side, and FIG. 8B is a plan view illustrating a state of the second retaining member with respect to the second releasing portion 3 after the supporting member 72 is released.

As illustrated in FIG. 8A, in mid-course of the mounting of the sheet feeding cassette 54 in the apparatus body 100*a*, the second releasing portion 3 abuts against the abutment portion 1*d* of the second retaining member 1 and pivots the second retaining member 1. Subsequently, as illustrated in FIG. 8B, when the protruding shaped supporting portion 72*a* provided on the supporting member 72 is released from the retaining claw portion 1*c* of the second retaining member 1, the abutment portion with respect to the second releasing portion 3 of the abutment portion 1*d* changes from a distal end portion 11*d* configured to abut against the abutting surface 3*a* of the second releasing portion 3 to an abutment against a lower surface portion 12*d*, and the pivot of the second retaining member 1 is substantially stopped.

In other words, in the second embodiment, the abutment portion 1*d* of the second retaining member 1 includes the distal end portion 11*d* configured to abut against the abutting surface 3*a* formed so as to face the mounting direction of the second releasing portion 3, and the lower surface portion 12*d* configured to allow sliding contact of an upper surface 3*b* of the second releasing portion 3. Until the retention of the pickup roller 51 at the waiting position by the second retaining member 1 is released, the distal end portion 11*d* of the abutment portion 1*d* abuts against the abutting surface 3*a* of the second releasing portion 3 to pivot the second retaining member 1 in the mounting direction. Subsequently, if the second retaining member 1 pivots until the retention by the second retaining member 1 being released, abutment between the distal end portion 11*d* of the second retaining member 1 and the abutting surface 3*a* is released. Therefore, even though the sheet feeding cassette 54 is moved further in the mounting direction, the second releasing portion 3 does not allow the second retaining member 1 to pivot in the mounting direction any longer since the upper surface 3*b* slides against the lower surface portion 12*d* of the abutment portion 1*d* of the second retaining member 1.

As described above, after the second retaining member 1 releases the retention of the supporting member 72, the abutment portion of the second retaining member 1 with respect to the second releasing portion 3 is changed from the distal end portion 11*d* to the lower surface portion 12*d*, and the pivot of the second retaining member 1 is substantially stopped. Accordingly, the space behind the second retaining member 1 may be used for arrangement of other components, and hence realization of the space-saving sheet feeding unit 6 is achieved.

Third Embodiment

Subsequently, a third embodiment will be described. In the following description, explanation of the same configuration as the first and second embodiments will be omitted.

Figure 9:
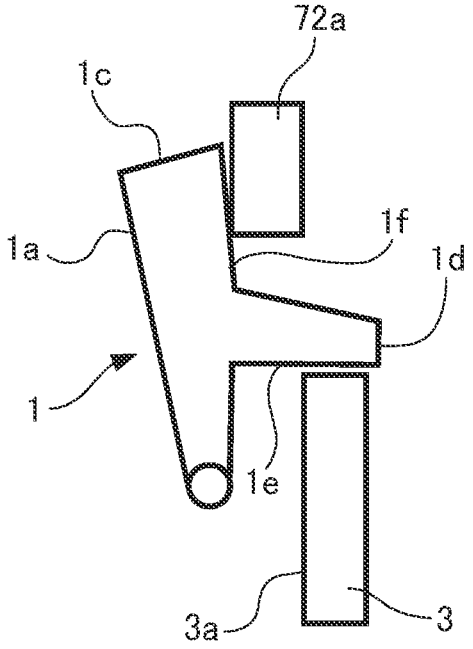
FIG. 9 is a plan view of the second retaining member of a third embodiment illustrating a state of completion of mounting of the sheet feeding cassette on the apparatus body.

FIG. 9 is a plan view illustrating a state of the second retaining member when the mounting of the sheet feeding cassette 54 in the apparatus body 100*a* is completed. In the third embodiment, if the retention of the supporting member 72 by the second retaining member 1 is released by the second releasing portion 3 on the sheet feeding cassette side, the state of the second retaining member 1 changes from a state with the distal end portion 11*d* abutting against the second releasing portion 3 to a state with the front surface portion 1*f* of the main body portion 1*a* abutting against the supporting portion 72*a* of the supporting member 72. Therefore, the second retaining member 1 pivots in the mounting direction along the inclination of the front surface portion 1*f* in conjunction with a dropping action of the supporting portion 72*a* of the supporting member 72 released from the retention by the second retaining member 1.

At this time, the amount of pivot of the second retaining member 1 is smaller than the amount of pivot of the second retaining member 1 when the abutment portion 1*d* of the second retaining member 1 and the second releasing portion 3 of the sheet feeding cassette 54 are in abutment with each other until the mounting of the sheet feeding cassette 54 in the apparatus body 100*a* is completed. Therefore, after the second retaining member 1 has released the retention of the supporting member 72, the amount of pivot of the second retaining member 1 is reduced, and hence the space behind the second retaining member 1 can be used for arrangement of other components. Therefore, the realization of the space-saving sheet feeding unit 6 is enabled. In addition, the second retaining member 1 may be disposed as close to the sheet mounting direction side as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2013-197766, filed on Sep. 25, 2013, and Japanese Patent Application No. 2014-171783, filed on Aug. 26, 2014, which are hereby incorporated by reference herein in their entirety.

What is claimed is:

1. A sheet feeding unit comprising:

an apparatus body;

a sheet storage portion configured to be mounted and drawn out with respect to the apparatus body;

a rotary feeding member configured to move, in accordance with a mounting action of the sheet storage portion, from a waiting position on which the rotary feeding member is apart from a sheet stored in the sheet storage portion to a feed position on which the rotary feeding member is in abutment with an upper surface of the sheet stored in the sheet storage portion to feed the sheet, and configured to move, in accordance with a drawing-out action, from the feed position to the waiting position;

a first retaining portion configured to retain the rotary feeding member at the waiting position in a case that the sheet storage portion is drawn out from a mounting position;

a first releasing portion provided on the sheet storage portion and configured to release a retention of the rotary feeding member at the waiting position by the first retaining portion in mid-course of mounting of the sheet storage portion in the apparatus body;

a second retaining portion configured to retain the rotary feeding member in a case that the retention of the rotary feeding member by the first retaining portion is released; and a second releasing portion provided on the sheet storage portion and configured to release a retention of the rotary feeding member at the waiting position by the second retaining portion in a case that the sheet storage portion is mounted at the mounting position in the apparatus body.

2. The sheet feeding unit according to claim 1, wherein the first retaining portion is supported by the apparatus body and adapted to pivot in a direction orthogonal to a mounting direction of the sheet storage portion on a side nearer to a front side of the apparatus body in the mounting direction than a leading edge position of the sheet storage portion located at the mounting position, and the second retaining portion is supported by the apparatus body and adapted to pivot in the mounting direction of the sheet storage portion on a side nearer to a back side of the apparatus body in the mounting direction than the first retaining portion.

3. The sheet feeding unit according to claim 2, wherein the second releasing portion includes an abutting surface formed so as to face the mounting direction, the second retaining portion includes an abutment portion formed so as to protrude in the drawing-out direction of the sheet storage portion and configured to abut against the second releasing portion, and the abutment portion abuts against the abutment surface of the second releasing portion to pivot the second retaining portion in the mounting direction until the retention of the rotary feeding member by the second retaining portion at the waiting position is released, and is released from abutment with the abutting surface when the retention by the second retaining portion is released.

4. The sheet feeding unit according to claim 1, further comprising:

a resilient member configured to bias the first retaining portion so as to retain the rotary feeding member at the waiting position, wherein the first retaining portion is configured to retain the rotary feeding member at the waiting position by being biased by the resilient member in a direction toward the sheet storage portion at the mounting position in the orthogonal direction, and the first releasing portion includes an inclined surface inclined in the mounting direction so as to abut against the first retaining portion in mid-course of mounting of the sheet storage portion at the mounting position of the apparatus body and release the retention of the rotary feeding member by pivoting the retaining plate against the resilient force of the resilient member.

5. The sheet feeding unit according to claim 1, wherein the second retaining portion includes a retaining claw portion biased so as to protrude from side wall on the back side in the mounting direction of the sheet storage portion in the apparatus body, and is configured to retain the rotary feeding member at the waiting position, and the second releasing portion releases the retention of the rotary feeding member by pushing in the retaining claw portion against a biasing force of the retaining claw portion when the sheet storage portion is mounted at the mounting position.

6. The sheet feeding unit according to claim 1, further comprising a supporting member configured to pivotally support the rotary feeding member, wherein the first retaining portion is configured to engage a supporting portion provided on the supporting member and push up the supporting member, thereby retaining the rotary feeding member at the waiting position, and the second retaining portion is positioned below the supporting portion of the supporting member and configured to support the supporting member to retain the rotary feeding member when the retention of the supporting member by the first retaining portion is released.

7. The sheet feeding unit according to claim 6, wherein the first retaining portion is configured to come into contact with the supporting member after the second retaining portion has released the retention of the rotary feeding member.

8. An image forming apparatus comprising:

the sheet feeding unit according to claim 1; and an image forming portion configured to form an image on a sheet fed by the sheet feeding unit.

9. A sheet feeding unit comprising:

an apparatus body;

a sheet storage portion configured to be mounted and drawn out with respect to the apparatus body;

a rotary feeding member configured to feed a sheet stored in the sheet storage portion;

a supporting member configured to rotatably support the rotary feeding member, and configured to pivot and move the rotary feeding member between a waiting position being apart from a sheet stored in the sheet storage portion and a feed position being in abutment with an upper surface of the sheet stored in the sheet storage portion for feeding the sheet;

a first retaining portion configured to push the supporting member upward from the underside to retain the rotary feeding member at the waiting position;

a first releasing portion provided on the sheet storage portion and configured to release the retention of the supporting member by the first retaining portion in mid-course of mounting of the sheet storage portion in the apparatus body;

a second retaining portion protruding on the underside of the supporting member when the first retaining portion retains the supporting member and configured to support the supporting member to retain the rotary feeding member in a case that a retention of the rotary feeding member by the first retaining portion is released; and a second releasing portion provided on the sheet storage portion, and configured to release the retention of the supporting member by the second retaining portion in association with the movement of the sheet storage portion in the mounting direction after the retention of the supporting member by the first retaining portion has been released by the first releasing portion.

10. The sheet feeding unit according to claim 9, further comprising a resilient member configured to bias the first retaining portion, wherein the supporting member is provided so as to pivot in a direction orthogonal to the mounting direction of the sheet storage portion, the first retaining portion is a retaining plate provided so as pivot in the same direction as the supporting member and configured to pivot so as to protrude toward a containing space of the sheet storage portion by an biasing force of the resilient member to push up the supporting member and retain the rotary feeding member at the waiting position, the first releasing portion includes an inclined surface inclined in the mounting direction so as to abut against the retaining plate in mid-course of mounting of the sheet storage portion in the apparatus body, and release the retention of the supporting member by the first retaining portion by pivoting the retaining plate against a biasing force of the resilient member.

11. The sheet feeding unit according to claim 10, wherein the second releasing portion includes an abutting surface formed so as to face the mounting direction, the second retaining portion includes an abutment portion formed so as to protrude in the drawing-out direction of the sheet storage portion and configured to abut against the second releasing portion, and the abutment portion is configured to abut against the abutting surface of the second releasing portion to pivot the second retaining portion in the mounting direction until the retention of the rotary feeding member at the waiting position by the second retaining portion is released, and is released from the abutment with the abutting surface when the retention by the second retaining portion is released.

12. The sheet feeding unit according to claim 9, wherein the apparatus body includes a stopper configured to restrict the position of the sheet storage portion in the mounting direction and fix the position at the mounting position, the second retaining portion starts releasing the retention of the supporting member by the second releasing portion before the position of the sheet storage portion in the mounting direction is restricted by the stopper, the retention of the supporting member by the second retaining portion is released at least when the position in the mounting direction of the sheet storage portion is restricted by the stopper to allow the rotary feeding member to move to the feed position.

13. The sheet feeding unit according to claim 9, wherein the rotary feeding member is located at the waiting position by the supporting member retained by the second retaining portion when the retention of the supporting member by the first retaining portion is released by the first releasing portion, and the rotary feeding member is moved to the feed position when the retention of the supporting member by the second retaining portion is released by the second releasing portion.

14. The sheet feeding unit according to claim 9, wherein the first retaining portion pushes up the supporting member from the underside when the sheet storage portion is drawn out from the apparatus body to move the rotary feeding member to the waiting position, and then the second retaining portion resiliently protrudes to the underside of the supporting member in association with the drawing-out of the sheet storage portion.

15. The sheet feeding unit according to claim 9, wherein the second retaining portion includes:

a main body of the retaining member;

a mounting portion configured to mount the main body of the retaining member on a side wall of the apparatus body on a back side in the mounting direction so as to pivot in the mounting direction and the drawing-out direction;

a retaining claw portion configured to engage the supporting member; and a biasing portion configured to bias the main body of the retaining portion in the drawing-out direction to bring the retaining claw portion and the supporting member into engagement so as to pivot the rotary feeding member at the waiting position.

16. The sheet feeding unit according to claim 9, wherein the second retaining portion configured to come into contact with the supporting member after the second retaining portion has released the retention of the rotary feeding member.

17. The sheet feeding unit according to claim 9, further comprising:

a feed roller arranged downstream of the rotary feeding member in the direction of sheet conveyance; and a retard roller configured to come into press contact with the feed roller to separate the sheets one by one, wherein the rotary feeding member is a pickup roller configured to feed the sheet to the feed roller, and the supporting member is pivotally provided on a shaft of the feed roller.

* * * * *